US009984619B2

(12) United States Patent
Kim et al.

(10) Patent No.: US 9,984,619 B2
(45) Date of Patent: May 29, 2018

(54) DISPLAY DEVICE AND METHOD FOR CONTROLLING POWER THEREOF

(71) Applicant: LG DISPLAY CO., LTD., Seoul (KR)

(72) Inventors: Jungjae Kim, Goyang-si (KR); Jaewon Han, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 154 days.

(21) Appl. No.: 14/977,097

(22) Filed: Dec. 21, 2015

(65) Prior Publication Data

US 2016/0189613 A1 Jun. 30, 2016

(30) Foreign Application Priority Data

Dec. 26, 2014 (KR) ..... 10-2014-0190755

(51) Int. Cl.

| | |
|---|---|
| ***G09G 3/32*** | (2016.01) |
| ***G09G 3/3233*** | (2016.01) |
| ***G09G 3/3291*** | (2016.01) |
| *G09G 3/36* | (2006.01) |

(52) U.S. Cl.

CPC ..... *G09G 3/3233* (2013.01); *G09G 3/3291* (2013.01); *G09G 3/3696* (2013.01); *G09G 2300/0809* (2013.01); *G09G 2310/08* (2013.01); *G09G 2320/0247* (2013.01); *G09G 2330/028* (2013.01)

(58) Field of Classification Search

CPC .. G09G 3/3233; G09G 3/3291; G09G 3/3696; G09G 2300/0809; G09G 2310/08; G09G 2320/0247; G09G 2330/028

See application file for complete search history.

(56) References Cited

U.S. PATENT DOCUMENTS

2002/0050973 A1 5/2002 Takaoka et al.
2006/0164366 A1* 7/2006 Yu ..... G09G 3/3648 345/98

FOREIGN PATENT DOCUMENTS

EP 1640965 A1 3/2006
EP 2 393 191 A2 12/2011

* cited by examiner

*Primary Examiner* — Lisa Landis

(74) *Attorney, Agent, or Firm* — Birch, Stewart, Kolasch & Birch, LLP

(57) ABSTRACT

A display device according to an embodiment includes a display panel, a driver, a power supply unit, and a power control unit. The power control unit may control the power supply unit in synchronization with a driving period of a device driving the display panel, and control one or more of synchronization signals of a scan driver, a data driver, and a timing controller and a switching frequency of a power generation transistor of the power supply unit to be synchronized.

13 Claims, 8 Drawing Sheets

- Hsync 3period = VDDEL 61period(1.22M/60K)
- Vsync 1period = Hsync 1Kperiod
  =VDDEL 20,333 + 1/3 period
- Vsync 3period = VDDEL 61K period = 20Hz

- Hsync 3period = VDDEL 61period(1.22M/60K)
- Vsync 1period = Hsync 1Kperiod
  =VDDEL 20,333 + 1/3 period
- Vsync 3period = VDDEL 61K period = 20Hz

- Hsync 1period = VDDEL 20period (1.20M/60K)
- Vsync 1period = Hsync 1Kperiod
  =VDDEL 20,000 period
- Vsync 1period = VDDEL 20K period = 60Hz

DISPLAY DEVICE AND METHOD FOR CONTROLLING POWER THEREOF

This application claims priority from and the benefit under 35 U.S.C. § 119(a) of Korean Patent Application No. 10-2014-0190755, filed on Dec. 26, 2014, which is incorporated herein by reference for all purposes as if fully set forth herein.

BACKGROUND OF THE INVENTION

Field of the Invention

The present disclosure relates to a display device and a driving method thereof.

Description of the Related Art

As the information technology has advanced, the market of display devices as mediums connecting users and information has grown. In line with this, the use of display devices such as liquid crystal displays (LCDs), organic light emitting display devices, electrophoretic displays (EPDs), and plasma display panels (PDPs) has increased.

Some of the aforementioned display devices, for example, the LCD or the organic light emitting display device includes a display panel including a plurality of subpixels disposed in a matrix form and a driver driving the display panel. The driver includes a scan driver supplying a scan signal (or a gate signal) to the display panel and a data driver supplying a data signal to the display panel.

The afore-mentioned display device displays a specific image as the display panel emits light or allows light to be transmitted therethrough on the basis of a voltage output from a power supply unit and the scan signal and the data signal output from the scan driver and the data driver.

In the related art, in order to improve a problem in which a screen of a display panel flickers due to wavering of power, a scheme of minimizing ripple of an output voltage by adding a low dropout regulator (LDO) to an output terminal of the power supply unit has been proposed.

However, the proposed scheme may be able to reduce wavering of power through the added regulator, but flickering is still present and power loss due to the added regulator degrades efficiency and increases complexity of circuits, causing an increase in manufacturing cost, which, thus, needs to be improved.

SUMMARY OF THE INVENTION

In an aspect of the present disclosure, there is provided a display device including a display panel, a driver, a power supply unit, and a power control unit. The display panel may display an image. The power supply unit may supply a source voltage to the display panel. The power control unit may control the power supply unit in synchronization with a driving period of a device driving the display panel, and control one or more of synchronization signals of a scan driver, a data driver, and a timing controller and a switching frequency of a power generation transistor of the power supply unit to be synchronized.

In another aspect of the present disclosure, there is also provided a method for driving a display device. The method for driving a display device may include: extracting a driving period of a device driving a display panel; extracting a driving period of a power supply unit supplying a source voltage to the display panel; and synchronizing the driving period of the device and a switching frequency of a power generation transistor for generating power of the power supply unit.

BRIEF DESCRIPTION OF THE DRAWINGS

The accompany drawings, which are included to provide a further understanding of the disclosure and are incorporated on and constitute a part of this specification illustrate embodiments of the disclosure and together with the description serve to explain the principles of the disclosure.

DETAILED DESCRIPTION OF PREFERRED EMBODIMENTS

Reference will now be made in detail embodiments of the disclosure examples of which are illustrated in the accompanying drawings.

Hereinafter, embodiments of the present disclosure will be described in detail with reference to the accompanying drawings.

A display device according to an embodiment of the present disclosure is implemented as a television, a set-top box (STB), a navigation device, a video player, a Blu-ray player, a personal computer (PC), a home theater, and a mobile phone. As a display panel of the display device, a liquid crystal display panel, an organic light emitting display panel, an electrophoretic display panel, or a plasma display panel may be selected, but the present disclosure is not limited thereto. However, hereinafter, for the purposes of descriptions, the organic light emitting display device will be described as an example.

Figure 1:
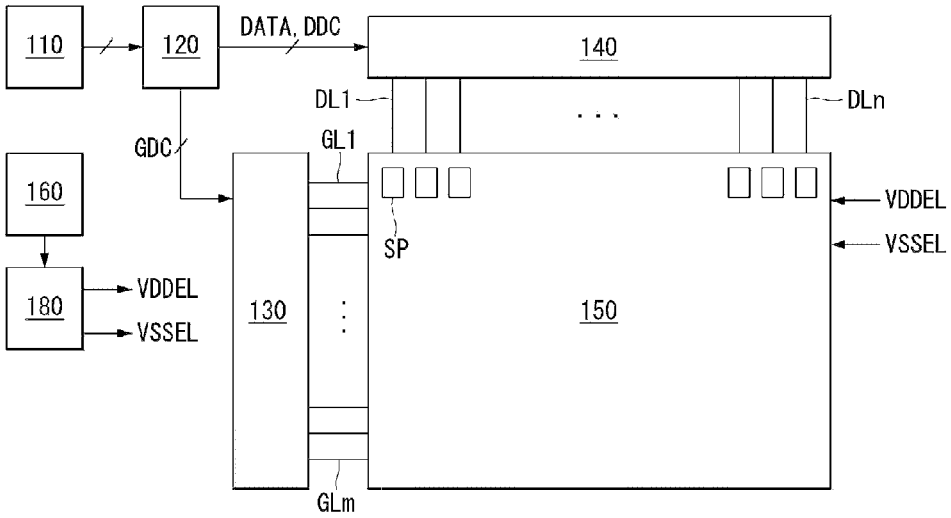
FIG. 1 is a block diagram schematically illustrating an organic light emitting display device.
Figure 2:
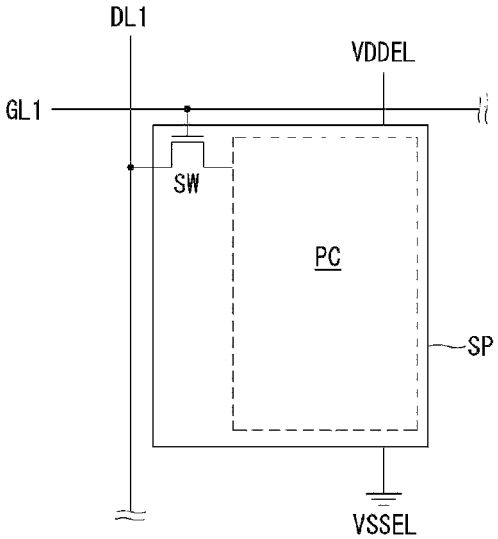
FIG. 2 is a view schematically illustrating a sub-pixel illustrated in FIG. 1.

FIG. 1 is a block diagram schematically illustrating an organic light emitting display device, and FIG. 2 is a view schematically illustrating a sub-pixel illustrated in FIG. 1.

As illustrated in FIG. 1, the organic light emitting display device includes an image supply unit 110, a timing controller 120, a scan driver 130, a data driver 140, a display panel 150, a power control unit 160, and a power supply unit 180.

In response to a scan signal and a data signal DATA output from the scan driver 130 and the data driver 140, the display panel 150 displays an image. The display panel 150 is implemented according to a top-emission scheme, a bottom-emission scheme, or a dual-emission scheme.

The display panel 150 is implemented as a flat panel type, a curved type, or a type having ductility. In the display panel 150, subpixels SP positioned between two substrates emit light in response to a driving current.

As illustrated in FIG. 2, a single subpixel includes a switching transistor SW connected to a scan line GL1 and a data line DL1 (or formed in an intersection between the scan line GL1 and the data line DL1), and a pixel circuit PC operated in response to the data signal DATA supplied through the switching transistor SW. The pixel circuit PC includes circuits such as a driving transistor, a storage capacitor, and an organic light emitting diode (OLED), and a compensation circuit.

In the subpixel, when the driving transistor is turned on in response to a data voltage stored in the storage capacitor, a driving current is supplied to the OLED positioned between a first power line VDDEL and a second power line VSSEL. The OLED emits light in response to the driving current.

The compensation circuit is a circuit for compensating for a threshold voltage, or the like, of the driving transistor. The compensation circuit includes one or more thin film transistors (TFTs) and a capacitor. The compensation circuit may be variously configured according to compensation methods, and thus, detailed illustration and descriptions thereof will be omitted. The TFTs are implemented on the basis of low-temperature polysilicon (LTPS), amorphous silicon (a-Si), an oxide, or an organic semiconductor layer.

The image supply unit 110 processes a data signal and outputs the data signal together with a vertical synchronization signal, a horizontal synchronization signal, a data enable signal, and a clock signal. The image supply unit 110 supplies the vertical synchronization signal, the horizontal synchronization signal, the data enable signal, the clock signal, and the data signal to the timing controller 120.

The timing controller 120 receives a data signal DATA, or the like, from the image supply unit 110 and outputs a gate timing control signal GDC for controlling an operation timing of the scan driver 130 and a data timing control signal DDC for controlling an operation timing of the data driver 140. The timing controller 120 supplies the data signal DATA together with the data timing control signal DDC to the data driver 140.

In response to the gate timing control signal GDC supplied from the timing controller 120, the scan driver 130 outputs a scan signal, while shifting a level of a gate voltage. The scan driver 130 includes a level shifter and a shift register. The scan driver 130 supplies a scan signal to subpixels SP included in the display panel 150 through scan lines GL1 to GLm.

The scan driver 130 may be formed in a gate-in-panel manner or formed as an integrated circuit (IC) on the display panel 150. A part formed in the gate-in-panel manner in the scan driver 130 is the shift register.

In response to the data timing control signal DDC supplied from the timing controller 120, the data driver 140 samples and latches the data signal DATA, converts a digital signal into an analog signal according to a gamma reference voltage, and outputs the converted digital signal.

The data driver 140 supplies the data signal DATA to the subpixels SP included in the display panel 150 through data lines DL1 to DLn. The data driver 140 may be formed as an integrated circuit (IC).

The power supply unit 180 generates power on the basis of input power supplied from the outside, and outputs the generated power. The power supply unit 180 drives a power generation transistor included therein to vary the input power to generate and output a first source voltage VDDEL and a second source voltage VSSEL. The power supply unit 180 may be configured as a DCDC converter converting an input first DC voltage into a second DC voltage different from the first DC voltage.

The first source voltage VDDEL and the second source voltage VSSEL output from the power supply unit 180 are supplied to the display panel 150. The first source voltage VDDEL is a high potential voltage, and the second source voltage VSSEL is a low potential voltage. In addition, the power supply unit 180 may generate power to be supplied to a control unit or a driving unit included in the display unit.

The power control unit 160 controls the power supply unit 180 by interworking with an external device. The power control unit 160 varies a switching period (frequency) of the power generation transistor of the power supply unit 180 by interworking with the external device.

The power control unit 160 varies a switching signal that controls the power generation transistor of the power supply unit 180. The power control unit 160 may be included in the power supply unit 180, may be positioned outside of the power supply unit 180, or may be included in other circuit unit. When the power control unit 160 is configured as a separate device (IC), the power control unit 160 may be mounted on the same circuit board on which the power supply unit 180 is mounted or the power control unit 160 and the power supply unit 180 may be mounted on different circuit boards. In this case, the power control unit 160, the power supply unit 180, and an external device may be electrically connected through a connector, a cable, or a signal line.

The display device described above displays a specific image as the display panel 150 emits light or allows light to be transmitted therethrough on the basis of the power VDDEL and VSSEL output from the power supply unit 180 and the scan signal and the data signal DATA output from the scan driver 130 and the data driver 140.

The power VDDEL and the VSSEL output from the power supply unit 180 need to maintain stability and reliability of output as well as high efficiency. On this account, in the related art, in order to improve a problem in which a screen of a display panel flickers due to wavering of power, a scheme of minimizing ripple of an output voltage by adding a low dropout regulator (LDO) to an output terminal of a power supply unit has been proposed.

Hereinafter, a problem of the conventionally proposed scheme will be considered and an embodiment of the present disclosure will be described.

[Related Art Structure]

Figure 3:
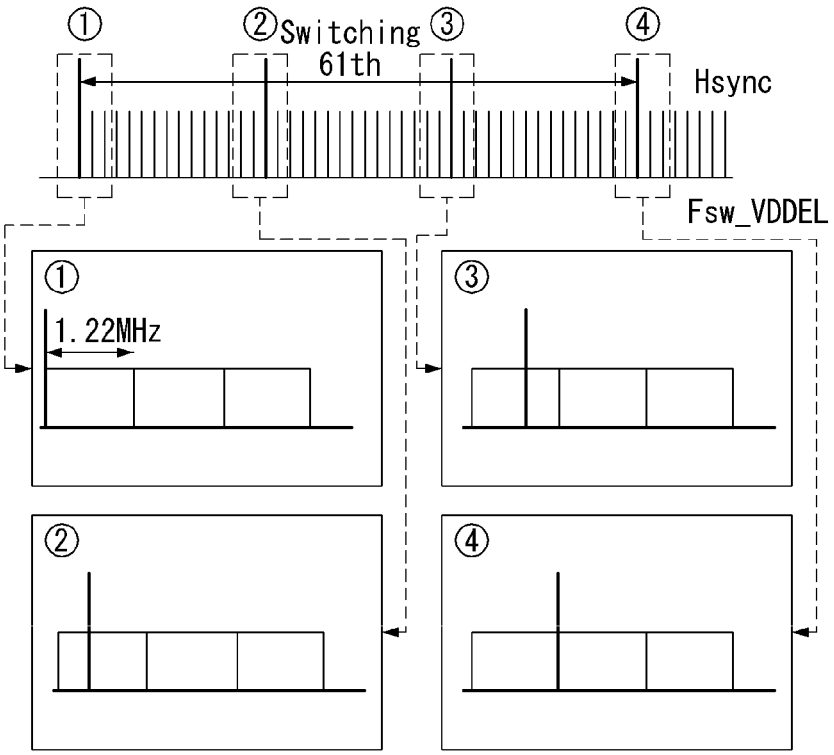
FIG. 3 is a waveform view illustrating a problem of the related art.
Figure 4:
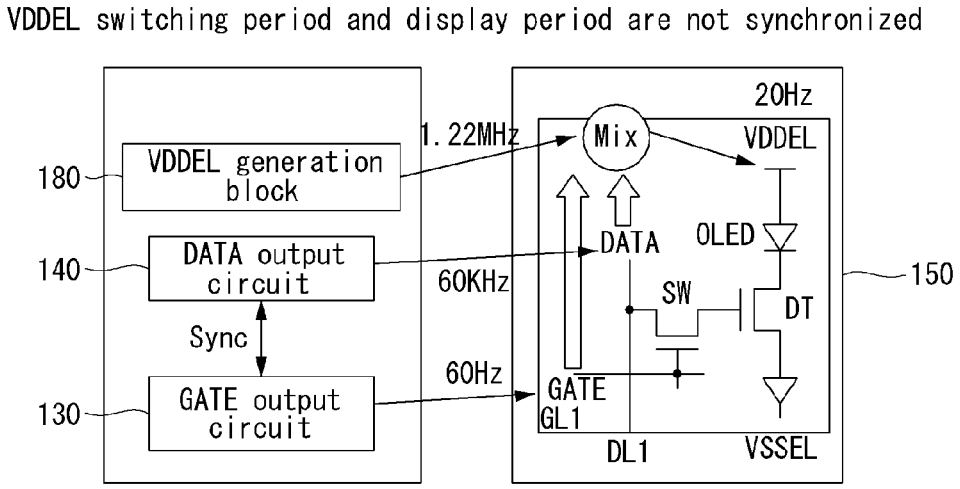
FIG. 4 is a view schematically illustrating a configuration of a portion of the related art display device.

FIG. 3 is a waveform view illustrating a problem of the related art, and FIG. 4 is a view schematically illustrating a configuration of a portion of the related art display device.

As illustrated in FIGS. 3 and 4, in the conventionally proposed scheme, the power generation transistor of the power supply unit 180 is controlled irrespective of (asynchronous scheme) a driving period of the device for driving the display panel 150.

In detail, the data driver 140 and the scan driver 130 are synchronized on the basis of a synchronization signal Sync, but unlike these elements, the power supply unit 180 is not synchronized with other device (it is simply controlled by the timing controller).

In FIG. 3, Fsw_VDDEL denotes a switching frequency of the power generation transistor. In FIG. 4, the display panel 150 is schematically illustrated to include a switching transistor SW, a driving transistor DT, and an organic light emitting diode (OLED). DATA denotes a data signal supplied to the first data line DL1 and GATE denotes a scan signal supplied to the first scan line GL1.

In the conventionally proposed display device, 1 frame was set to 60 Hz, the number of horizontal lines was 1K, a horizontal synchronization signal Hsync was set to 60 KHz, a switching frequency of the power generation transistor for generating and supplying the first source voltage VDDEL was set to 1.2 MHz, and in this state, a driving period of the display device was observed and, as a result, these signals had the following relationships.

Horizontal synchronization signal (Hsync) 4 periods=first source voltage (VDDEL) 61 periods (1.22 M/60 K)

Vertical synchronization signal 1 period=horizontal synchronization signal (Hsync) 1K period=first source voltage (VDDEL) 20,333+1/3 period Vertical synchronization signal (Vsync) 3 periods=first source voltage (VDDEL) 61K periods=20 Hz According to the foregoing relationships, in the conventionally proposed display device, the switching period of the first source voltage VDDEL and the driving period of the display panel 150 are not synchronized. As a result, in the conventionally proposed display device, a minimum frequency component of a ripple frequency component of the first source voltage VDDEL is lowered to 20 Hz, and thus, flickering increases when the device operates.

For reference, in case of vertical synchronization signal (Vsync) 60 Hz driving, flickering at a level of 60 Hz may be anticipated, but in actuality, flickering at a level of 20 Hz is recognized. As for the problem, in particular, when the frequency of ripple of the first source voltage VDDEL for driving the organic light emitting display device is lowered, it is recognized as flickering.

In the conventionally proposed display device, the switching frequency of the power generation transistor for generating and supplying the first source voltage VDDEL was set to 1.2 MHz, but a frequency deviation of 1.22 MHz occurred when driven due to a variation of an oscillator within the power supply unit 180.

Thus, it was confirmed that the conventionally proposed scheme is vulnerable to the ripple frequency component affecting an output terminal outputting the first source voltage VDDEL of the power supply unit 180. For example, the ripple frequency component affecting the output terminal of the power supply unit 180 is as follows.

1) Coupling based on a frequency component of the horizontal synchronization signal due to a parasitic capacitor component, or the like, within the display panel 150, 2) a switching frequency component of the power generation transistor for generating the first source voltage VDDEL, and 3) a load transient voltage generated at a current period according to circumstances.

According to results obtained by analyzing the foregoing components, it appeared that the ripple frequency components occurred frequently when driving periods are not in an integer multiple relationship (not synchronized to each other).

Thus, a mixed frequency that may be observed in the first source voltage VDDEL may be very small. As a result, a period of ripple that may be observed in the first source voltage VDDEL may be significantly increased, and due to the large period, a change period of a current flowing in a subpixel (e.g., an OLED) may also be increased as much. When a change in the current of the large period is increased enough to be sufficiently visible to human beings' eyes, it is recognized as flicker.

Thus, in the related art, wavering of power can be reduced by adding a regulator to an output terminal of the first source voltage VDDEL of the power supply unit 180. However, the conventionally proposed scheme still involves flicker, power loss of the regulator that degrades efficiency, and high complexity of circuits that increases manufacturing cost.

[Structure of Embodiment]

Figure 5:
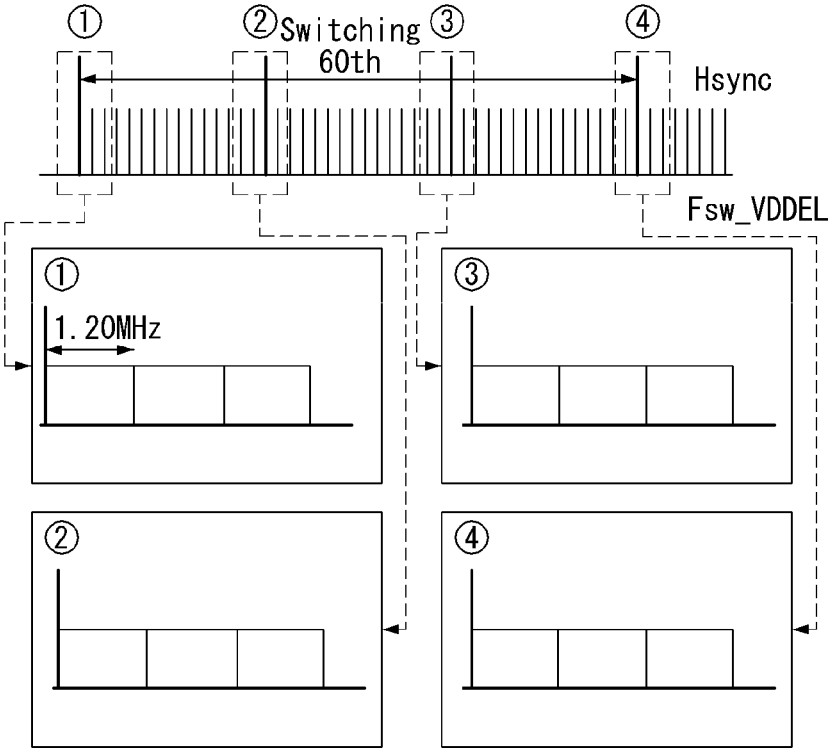
FIG. 5 is a waveform view schematically illustrating an embodiment of the present disclosure.
Figure 6:
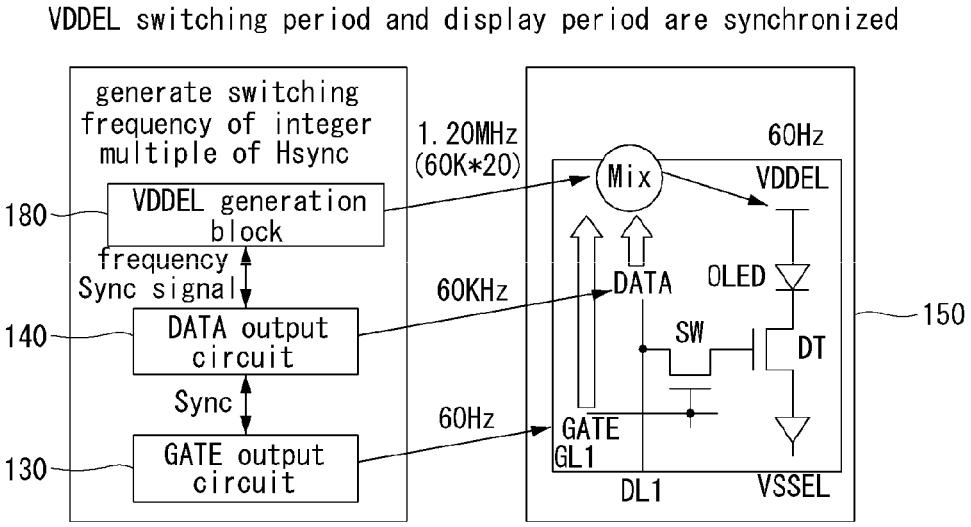
FIG. 6 is a view schematically illustrating a configuration of a portion of a display device according to an embodiment of the present disclosure.

FIG. 5 is a waveform view schematically illustrating an embodiment of the present disclosure, and FIG. 6 is a view schematically illustrating a configuration of a portion of a display device according to an embodiment of the present disclosure.

As illustrated in FIGS. 5 and 6, in an embodiment of the present disclosure, the power generation transistor of the power supply unit 180 is controlled in synchronization with a driving period of a device driving the display panel 150.

In detail, the data driver 140, the scan driver 130, and the power supply unit 180 are synchronized on the basis of a synchronization signal Sync. In particular, a switching period of the power generation transistor of the power supply unit 180 is varied on the basis of the synchronization signal Sync such as the horizontal synchronization signal Hsync for controlling the data driver 140 and the scan driver 130. The switching period may be varied on the basis of a vertical synchronization signal.

In FIG. 5, Fsw_VDDEL denotes a switching frequency of the power generation transistor. In FIG. 6, the display panel 150 is schematically illustrated to include a switching transistor SW, a driving transistor DT, and an organic light emitting diode (OLED). DATA denotes a data signal supplied to the first data line DL1 and GATE denotes a scan signal supplied to the first scan line GL1.

In the display device according to an embodiment of the present disclosure, 1 frame was set to 60 Hz, the number of horizontal lines was 1K, a horizontal synchronization signal Hsync was set to 60 KHz, a switching frequency of the power generation transistor for generating and supplying the first source voltage VDDEL was set to 1.2 MHz, and in this state, a driving period of the display device was observed and, as a result, these signals had the following relationships.

Horizontal synchronization signal (Hsync) 1 period=first source voltage (VDDEL) 20 periods (1.20M/60K)

Vertical synchronization signal 1 period=horizontal synchronization signal (Hsync) 1K period=first source voltage (VDDEL) 20,000 periods Vertical synchronization signal (Vsync) 1 period=first source voltage (VDDEL) 20K periods=60 Hz According to the foregoing relationships, in the display device according to an embodiment of the present disclosure, the switching period of the first source voltage VDDEL and the driving period of the display panel 150 are synchronized. As a result, in the display device according to an embodiment of the present disclosure, a ripple frequency component of the first source voltage VDDEL appears as 60

Hz, and thus, the horizontal synchronization signal Hsync and the switching frequency for generating the first source voltage VDDEL are synchronized.

To this end, in the scheme according to an embodiment of the present disclosure, the driving frequencies of the scan driver 130, the data driver 140, and the power supply unit 180 are synchronized (or integer-multiplied) such that a frequency with respect to mixed components of the driving frequencies is not reduced.

In this manner, in the scheme according to an embodiment of the present disclosure, since the frequency of the mixed components of the driving frequencies is maintained at a level (about 60 Hz) of the vertical synchronization signal Vsync (not to be lowered to below Vsync), flickers that may be recognized by human beings' eyes may be removed.

In the scheme according to an embodiment of the present disclosure, even though an oscillator deviation occurs in the power supply unit 180, the deviation compensation is performed through a synchronization process with an external device. Thus, a problem in which a frequency deviation of 1.22 MHz, beyond 1.2 mHz occurs in the switching frequency set due to the oscillator deviation as in the conventionally proposed scheme does not arise.

As described above, in the conventionally proposed scheme, the ripple frequency of the first source voltage VDDEL is lowered and it is impossible to predict in which form the ripple frequency will appear as a frequency component, and thus, flickers appearing on the display panel 150 are intensely recognized. In contrast, in the scheme according to an embodiment of the present disclosure, since there is a high possibility in which the ripple frequency of the first source voltage VDDEL maintains at 60Hz, flickers appearing on the display panel 150 are insignificantly recognized.

Hereinafter, an example of a configuration of a display device for achieving an embodiment of the present disclosure will be described.

Figure 7:
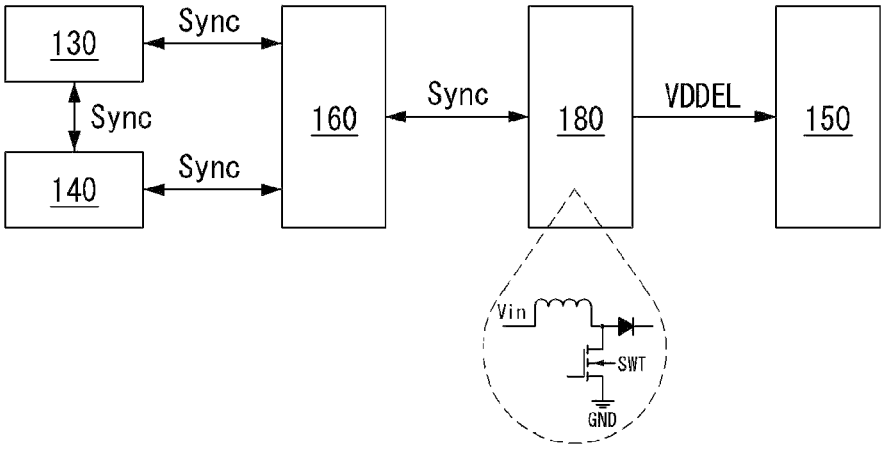
FIG. 7 is a view illustrating a first configuration of a display device according to an embodiment of the present disclosure.
Figure 8:
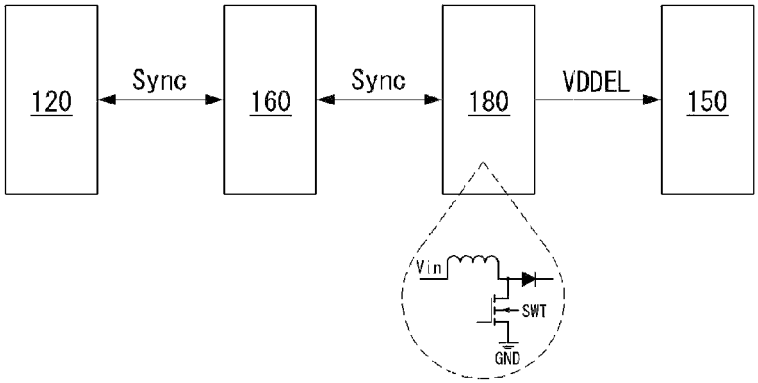
FIG. 8 is a view illustrating a second configuration of a display device according to an embodiment of the present disclosure.

FIG. 7 is a view illustrating a first configuration of a display device according to an embodiment of the present disclosure, and FIG. 8 is a view illustrating a second configuration of a display device according to an embodiment of the present disclosure. In FIGS. 7 and 8, Vin denotes an input voltage supplied to the power supply unit 180, and GND denotes a ground voltage.

As illustrated in FIG. 7, in the display device according to a first configuration, three devices, i.e., the power supply unit 180, the scan driver 130, and the data driver 140, are synchronized by the power control unit 160.

The power control unit 160 varies a switching period of the power generation transistor SWT of the power supply unit 180 by interworking with the scan driver 130 and the data driver 140. For example, with reference to driving frequencies (or driving periods) of the scan driver 130 and the data driver 140, the power control unit 160 synchronizes the driving frequencies and a switching signal for controlling the power generation transistor SWT of the power supply unit 180. To this end, the power control unit 160 may refer to a vertical synchronization signal of the scan driver 130 and a horizontal synchronization signal of the data driver 140.

As illustrated in FIG. 8, in the display device according to the second configuration, two devices, i.e., the power supply unit 180 and the timing controller 120, are synchronized by the power control unit 160.

The power control unit 160 varies a switching period of the power generation transistor SWT of the power supply unit 180 by interworking with the timing controller 120.

For example, with reference to a driving frequency (or a driving period) of the timing controller 120, the power control unit 160 synchronizes the driving frequency and a switching signal that controls the power generation transistor SWT of the power supply unit 180. To this end, the power control unit 160 may refer to a vertical synchronization signal and a horizontal synchronization signal of the timing controller 120.

Meanwhile, the power supply unit 180 may synchronize a driving frequency thereof on the basis of a signal supplied from the power control unit 160. The power supply unit 180 may transfer a signal thereof to the power control unit 160 such that the power control unit 160 and other device may be synchronized on the basis of the driving frequency.

In this manner, the power supply unit 180 may perform passive synchronization or active synchronization with a device interworking therewith according to a way in which the power control unit 160 is configured. An example thereof will be described.

Figure 9:
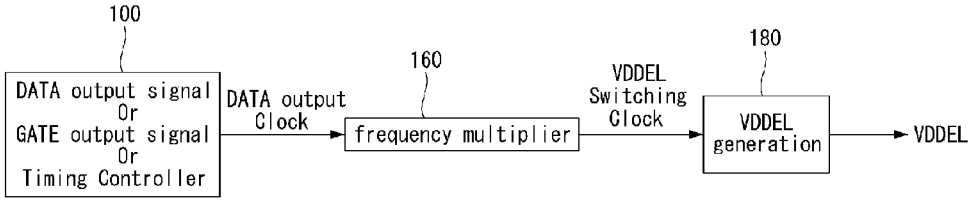
FIG. 9 is a view illustrating a first configuration of a power control unit according to an embodiment of the present disclosure.
Figure 10:
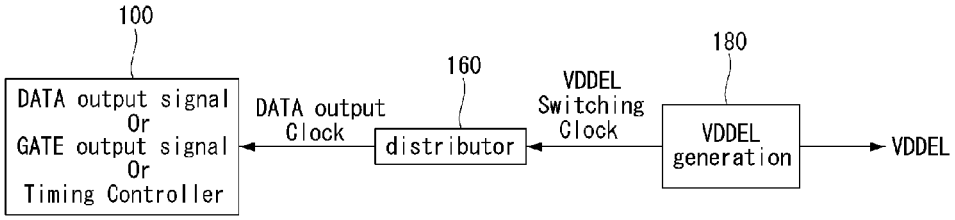
FIG. 10 is a view illustrating a second configuration of a power control unit according to an embodiment of the present disclosure.

FIG. 9 is a view illustrating a first configuration of a power control unit according to an embodiment of the present disclosure, and FIG. 10 is a view illustrating a second configuration of a power control unit according to an embodiment of the present disclosure.

As illustrated in FIG. 9, the power control unit 160 includes a frequency multiplier for multiplying a frequency. The frequency multiplier may receive a signal (DATA output clock) from a driving device 100 such as the timing controller, the scan driver, or the data driver, and generate a signal (voltage or current) of high frequency corresponding to an integer multiple thereof on the basis of the received signal.

When the power control unit 160 is configured on the basis of the frequency multiplier, the power control unit 160 may recognize a driving period of the device on the basis of the signal (DATA output clock) supplied from the driving device 100, and generate and output a switching signal (VDDEL switching clock) that controls the power generation transistor of the power supply unit with a frequency corresponding to the integer multiple.

As a result, the power supply unit 180 may generate and output a first source voltage VDDEL in a state in which it can be synchronized with the driving device 100 in response to the switching signal (VDDEL switching clock) output from the power control unit 160.

As illustrated in FIG. 10, the power control unit 160 includes a frequency distributor (frequency divider) capable of distributing (dividing) a frequency. The frequency distributor (frequency divider) may receive a switching signal (VDDEL switching clock) from the power supply unit 180 and generate a signal (voltage or current) of a low frequency corresponding to an integer multiple thereof on the basis of the switching signal.

In a case in which the power control unit 160 is configured on the basis of the frequency distributor (frequency divider), the power control unit 160 may recognize a driving period of the device on the basis of the switching signal (VDDEL switching clock) supplied from the power supply unit 180, and generate and output a signal (DATA output clock) for controlling the driving device 100 such as the timing controller, the scan drier, or the data driver with a frequency corresponding to the integer multiple.

As a result, the driving device 100 may generate and output a data signal or a scan signal in a state in which it can be synchronized with the power supply unit 180 in response to the signal (DATA output clock) output from the power control unit 160.

Figure 11:
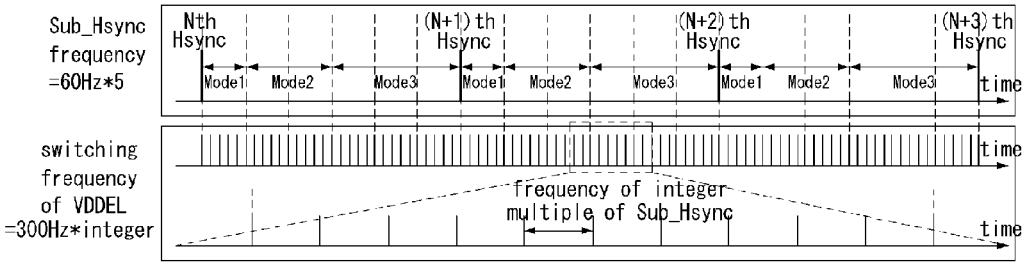
FIG. 11 is a waveform view illustrating an application example of a display device according to an embodiment of the present disclosure.
Figure 12:
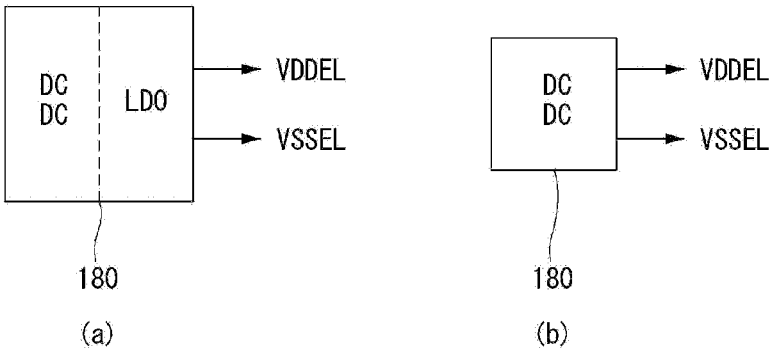
FIG. 12 is a view illustrating a comparison between configurations of a related art power supply unit and a power supply unit according to an embodiment of the present disclosure.

FIG. 11 is a waveform view illustrating an application example of a display device according to an embodiment of the present disclosure, and FIG. 12 is a view illustrating a comparison between configurations of a related art power supply unit and a power supply unit according to an embodiment of the present disclosure.

In an embodiment of the present disclosure, even when driving is performed by dividing 1 horizontal period into N (N is an integer of 2 or greater) number of sub-horizontal periods, driving frequencies of devices may be synchronized to correspond to a unit frequency.

As illustrated in FIG. 11, in an embodiment of the present disclosure, when the display device is driven by dividing 1 horizontal period (Nth Hsync) of the display device into three sub-horizontal periods (Mode 1 to Mode 3), a sub-horizontal synchronization signal (Sub_Hsync) corresponding to a unit frequency may be synchronized with a frequency of the switching signal for generating the first source voltage VDDEL.

As illustrated in (a) of FIG. 12, the conventionally proposed display device controls the switching signal for generating the first source voltage VDDEL of the power supply unit irrespective of a driving period (asynchronous scheme) of the device driving the display panel.

In order to improve flicker, the conventionally proposed display device should add a regulator (LDO) to an output terminal of the first source voltage VDDEL in addition to the source voltage generation unit DCDC for generating the first source voltage VDDEL in the power supply unit 180. However, the conventionally proposed scheme still involves flicker, and power loss due to the regulator (LDO) degrades efficiency, and high complexity of the circuit increases manufacturing cost.

In contrast, as illustrated in (b) of FIG. 12, the display device according to an embodiment of the present disclosure controls the switching signal for generating the first source voltage VDDEL of the power supply unit 180 in synchronization with a driving period of the device driving the display panel.

As a result, the display device according to an embodiment of the present disclosure can considerably improve flicker only with the source voltage generation unit DCDC for generating the first source voltage VDDEL in the power supply unit 180, compared with the related art structure. Also, in the display device according to an embodiment of the present disclosure, since the regulator (LDO) is omitted, power loss is improved to enhance efficiency, and since the circuit complexity (circuit simplification toward compactness) is lowered, manufacturing cost can be reduced.

In the above, the power control unit has been described as a device for controlling the power supply unit of the display device. However, it is merely illustrative and the power control unit may be applied to any electronic device operated on the basis of a power supply unit.

Meanwhile, the problem in which flicker is recognized (or visible) on the display panel even with small ripple (very small ripple) generated in the output terminal of the power supply unit is more sensitive to an organic light emitting display device than to a liquid crystal display device. Thus, it is expected that the embodiment of the present disclosure may have higher efficiency when applied to the organic light emitting display device.

Hereinafter, a method for driving a display device according to an embodiment of the present disclosure will be described.

Figure 13:
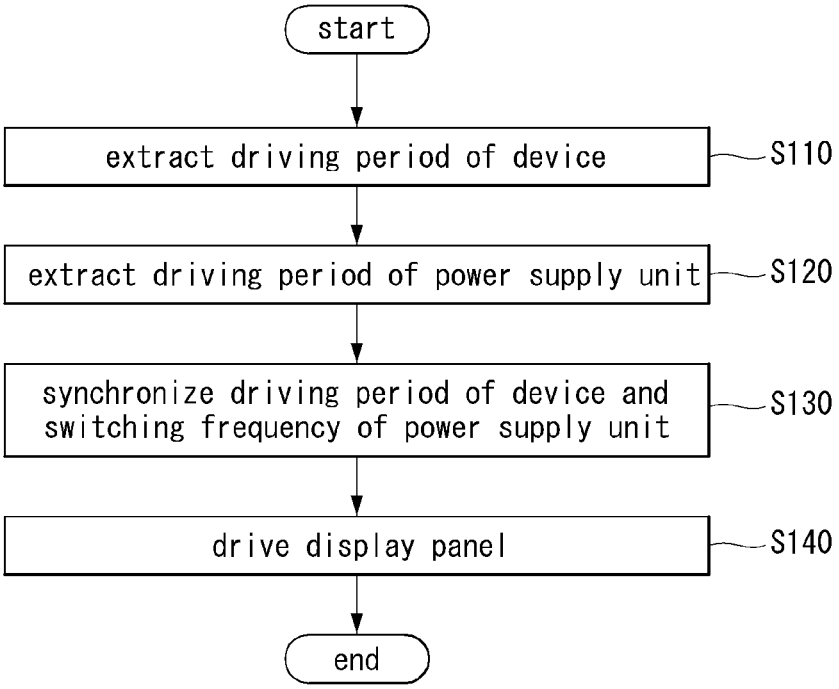
FIG. 13 is a flow chart illustrating a method for driving a display device according to an embodiment of the present disclosure.

FIG. 13 is a flow chart illustrating a method for driving a display device according to an embodiment of the present disclosure.

As illustrated in FIG. 13, a driving period of a device driving a display panel is extracted (S110). Next, a driving period of a power supply unit supplying a source voltage to the display panel is extracted (S120). Thereafter, the driving period of the device driving the display panel and a switching frequency of the power generation transistor of the power supply unit are synchronized (S130). Thereafter, power, a data signal, and a scan signal are supplied to the display panel to drive the display panel (S140).

In order to synchronize the driving period of the device driving the display panel and the switching frequency of the power generation transistor of the power supply unit, the scheme of varying the driving period of the device driving the display panel and the switching frequency of the power generation transistor of the power supply unit as described above may be used. Also, a scheme of varying the driving period of the device driving the display panel in synchronization with the switching frequency of the power generation transistor of the power supply unit may also be used.

As described above, the problem in which flicker is recognized (or visible) on the display panel even with small ripple (very small ripple) of a voltage generated in the output terminal of the power supply unit can be improved and stability and reliability of an output may be maintained. In addition, since the regulator positioned in the output terminal of the power supply unit is omitted, power loss can be improved to enhance efficiency, and circuit complexity can be lowered to reduce manufacturing cost.

What is claimed is:

1. An organic light emitting display device comprising:

a display panel including subpixels each of which includes an organic light emitting diode;

a power supply unit comprising a power generation transistor to vary input power to generate and supply a first source voltage to the organic light emitting diodes of the subpixels of the display panel; and a power control unit, implemented as an integrated circuit, to control the power supply unit in synchronization with a driving period of a device driving the display panel, wherein the power control unit performs control such that one or more of synchronization signals of a scan driver, a data driver, and a timing controller and a switching frequency of the power generation transistor of the power supply unit are synchronized to generate the first source voltage in synchronization with the driving period.

2. The organic light emitting display device of claim 1, wherein the power control unit varies the switching frequency of the power generation transistor of the power supply unit in synchronization with the driving period of the device driving the display panel.

3. The organic light emitting display device of claim 1, wherein the power control unit varies the driving period of the device driving the display panel in synchronization with the switching frequency of the power generation transistor of the power supply unit.

4. The organic light emitting display device of claim 1, wherein the power control unit comprises a frequency multiplier configured to receive a signal from the device driving the display panel and generate a signal of a high frequency corresponding to an integer multiple thereof on the basis of the received signal.

5. The organic light emitting display device of claim 1, wherein the power control unit comprises a frequency distributor or a frequency divider configured to receive a signal from the power supply unit and generate a signal of a low frequency corresponding to an integer multiple thereof on the basis of the received signal.

6. The organic light emitting display device of claim 1, wherein the power control unit varies the switching frequency of the power generation transistor of the power supply unit in synchronization with a frequency of a vertical synchronization signal, a horizontal synchronization signal, or a sub-horizontal synchronization signal dividing 1 horizontal period of the horizontal synchronization signal into N number of sub-horizontal periods, where N is an integer greater than or equal to two.

7. A method for driving an organic light emitting display device, the method comprising:

extracting a driving period of a device driving a display panel;

extracting a driving period of a power supply unit comprising a power generation transistor to vary input power to generate and supply a first source voltage to the display panel; and synchronizing the driving period of the device driving the display panel and a switching frequency of the power generation transistor of the power supply unit to generate the first source voltage in synchronization with the driving period.

8. The method of claim 7, wherein the synchronizing comprises varying the switching frequency of the power generation transistor of the power supply unit in synchronization with the driving period of the device driving the display panel or varying the driving period of the device driving the display panel in synchronization with the switching frequency of the power generation transistor of the power supply unit.

9. The method of claim 8, wherein the varying the switching frequency of the power generation transistor in synchronization with the driving period of the device driving the display panel is carried out by a power control unit of the display device.

10. The method of claim 8, wherein the varying the driving period of the device driving the display panel in synchronization with the switching frequency of the power generation transistor is carried out by a power control unit of the display device.

11. The method of claim 9, wherein a frequency multiplier of the power control unit receives a signal from the device driving the display panel and generates a signal of a high frequency corresponding to an integer multiple thereof on the basis of the received signal.

12. The method of claim 9, wherein a frequency distributor or a frequency divider of the power control unit receives a signal from the power supply unit and generates a signal of a low frequency corresponding to an integer multiple thereof on the basis of the received signal.

13. The method of claim 9, wherein the power control unit varies the switching frequency of the power generation transistor of the power supply unit in synchronization with a frequency of a vertical synchronization signal, a horizontal synchronization signal, or a sub-horizontal synchronization signal dividing 1 horizontal period of the horizontal synchronization signal into N number of sub-horizontal periods, where N is an integer greater than or equal to two.

* * * * *